United States Patent [19]

Gandhi

[11] Patent Number: 4,792,726

[45] Date of Patent: Dec. 20, 1988

[54] FLUORESCENT LAMP UNIT WITH INTEGRAL BALLAST HOUSING

[75] Inventor: Harish F. Gandhi, Salem, Mass.

[73] Assignee: North American Philips Corporation, New York, N.Y.

[21] Appl. No.: 100,687

[22] Filed: Sep. 24, 1987

[51] Int. Cl.[4] ..... H01J 7/44

[52] U.S. Cl. ..... 315/52; 315/56

[58] Field of Search ..... 315/58, 50, 53, 52, 315/56; 313/25

[56] References Cited

U.S. PATENT DOCUMENTS

| | | | |
|---|---|---|---|
| 2,279,635 | 4/1942 | Morley | 313/25 |
| 3,781,593 | 12/1973 | Rodriguez | 315/58 |
| 4,270,071 | 5/1981 | Morton | 315/58 |
| 4,449,071 | 5/1984 | Yokoyama et al. | 315/58 |
| 4,570,104 | 2/1986 | Janssen | 315/50 |

*Primary Examiner*—David K. Moore

*Attorney, Agent, or Firm*—F. Brice Faller

[57] ABSTRACT

A fluorescent lamp unit adapted for use in an incandescent lamp socket includes a tube, a cap member having a base wall in which the tube is fixed, and a ballast housing having a primary cavity which is substantially defined by a circumferential wall and closed toward the cap member to create a secondary cavity which thermally isolates the tube from the ballast. The housing further includes a partition which isolates conduits for the wire leads from the primary cavity and each other, whereby uninsulated leads may be used. A potted ballast completely fills the primary cavity to improve heat dissipation through the circumferential wall.

7 Claims, 2 Drawing Sheets

FLUORESCENT LAMP UNIT WITH INTEGRAL BALLAST HOUSING

BACKGROUND OF THE INVENTION

The present invention relates to a lamp unit comprising a fluorescent tube with electrodes having wire leads extending therefrom, a lamp base to which the leads are connected, and a ballast housing betwen the tube and the base. The housing has a forward end toward the lamp base, and a circumferential wall extending therebetween. The wall at least partially defines a primary cavity having therein an inductive stabilization ballast through which at least one of the leads is wired.

U.S. Pat. No. 4,353,007 describes a lamp unit of the above described type, the housing having an integral shell portion which converges toward the rearward end and a floor portion between the ends to support the ballast. The ballast is situated in the primary cavity with a circumferential space between it and the circumferential wall, in which space the wire leads are located for connection to the ballast, the base, or a starter located in the shell portion. The primary cavity is completely open toward the forward end to receive the leads.

The prior art lamp unit requires that the wire leads be insulated in order to prevent short circuiting. Since the forward end of the housing is open, the discharge tube extends into the primary cavity and thus is not thermally isolated from the ballast. Further, the circumferential space around the ballast acts as an insulator.

SUMMARY OF THE INVENTION

It is an object of the invention to provide a ballast housing with feed through uninsulated lead wires. According to the invention, therefore, the housing includes partition means isolating the primary cavity from individual wire conduits lying between the partition means and the circumferential wall. The conduits extend between the forward and rearward ends of the housing, and have respective leads therein. In a preferred embodiment, the partition means is a major partition bridging the circumferential wall. The housing further includes a plurality of minor partitions extending between the major partition and the circumferential wall, the minor partitions paralleling the conduits.

It is a further object to thermally isolate the lamp tube from the ballast. To this end, the housing further includes a barrier which closes the cavity at the forward end of the housing. The lamp unit may further include a cap member which fits against the forward end of the housing to define a secondary cavity which receives the electrodes.

It is a further object to improve the thermal performance of the lamp unit. To this end the ballast is surrounded by a compound which completely fills the primary cavity, whereby considerable heat is dissipated directly through the circumferential wall.

It is yet another object to provide a lamp unit which is relatively low cost. To this end the housing and cap member, are injection molded plastic pieces which are ultrasonically bonded together without additional retention means being necessary. A discrete shell member which fits against the rearward end of the housing is likewise injection molded plastic and can readily be molded with retention means for the base.

It is a further object to achieve a fluorescent lamp unit having an incandescent lamp base, which lamp unit is more compact than prior art units of this type.

Other objects and advantages of the invention will be apparent upon reading the detailed description which follows.

DETAILED DESCRIPTION OF THE PREFERRED EMBODIMENT

Figure 1:
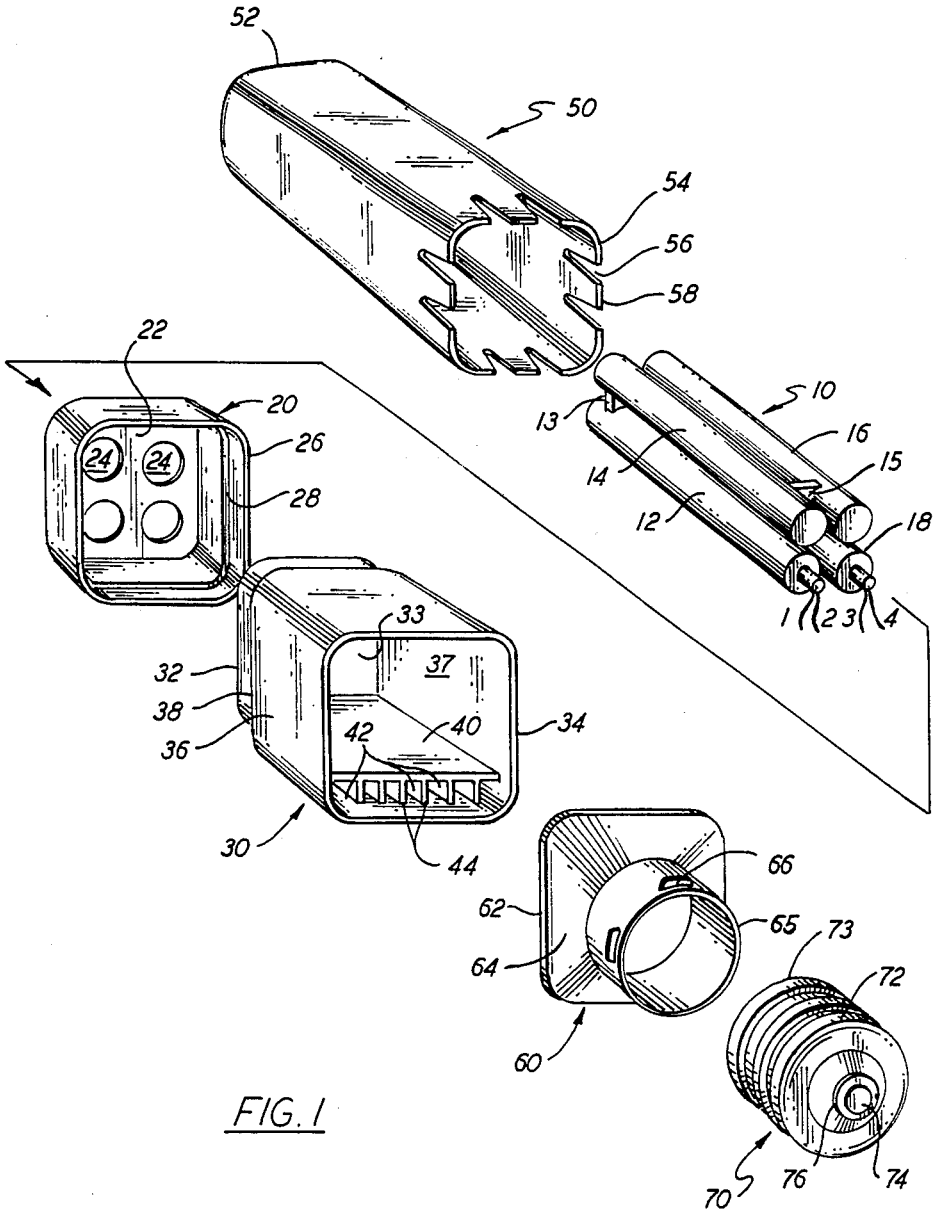
FIG. 1 is an exploded perspective of the lamp unit sans ballast.

Referring to FIG. 1, the lamp tube 10 includes four tube members 12, 14, 16, 18 which are connected by hollow links 13, 15, 17 to form a single low pressure mercury vapor discharge chamber (the tube 17 is not visible, but connects the members 16, 18 adjacent to the link 13 between 12, 14). The link members 12, 18 each have coil-type electrodes in one end thereof; leads 1, 2 are connected to opposite sides of the electrode in tube member 12 while leads 3, 4 are connected to opposite sides of the electrode in tube member 18. The lead 1 is wired through a ballast to a base contact while lead 4 is wired directly to a base contact. Leads 2 and 3 are wired in series with a starter in conventional fashion. See the diagram for a single lamp simple choke ballast at page 3-64 of The Lighting Handbook (copyright 1984 by North American Philips Lighting Corporation).

A cap member 20 includes a base wall 22 having apertures 24 which receive the ends of respective tube members, and a circumferential wall 26 upstanding from base wall 22. The inside surface of wall 26 has a recessed shoulder 28 which fits against the housing 30 as will be described. The member 20 is preferably injection molded of a glass filled plastic such as Ryton or Valox.

The housing 30 has a forward end 32, a rearward end 34, and a circumferential wall 36 extending therebetween. The wall 36 substantially defines a primary cavity 37 which is closed by a barrier 33 at forward end 32. The cavity 37 is further defined by a major partition 40 which isolates it from wire conduits 42, the conduits 42 being isolated from each other by minor partitions 44 extending between the major partition and the circumferential wall. Only the conduits 42 open on barrier 33; alternate spaces between the conduits 42 are closed at wall 33 and serve to space and insulate the wire leads from each other, as well as assuring uniform setting of the plastic. It will be apparent that the alternate spaces are not essential to the invention. The outside surface of wall 36 has a shoulder 38 recessed from forward end 32, which shoulder 38 facilitates the assembly of cap member 20 and cover member 50.

Figure 2:
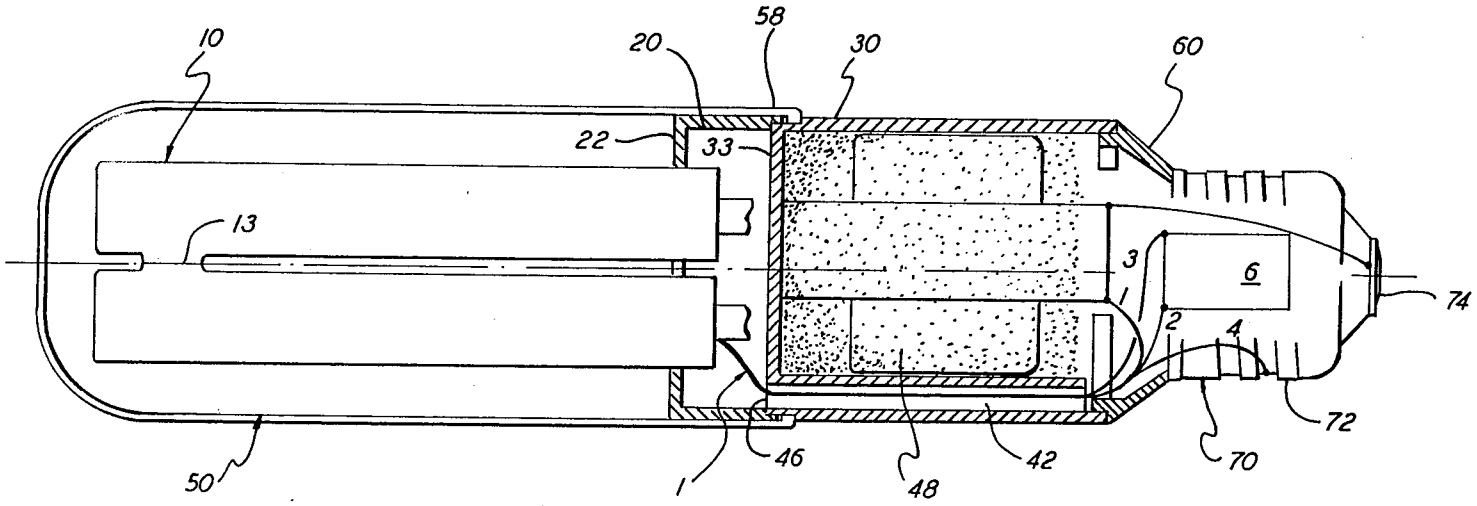
FIG. 2 is a cross section of the assembled lamp unit.

The elongate cover member 50 has a forward or closed end 52 and a rearward or open end 54. The cover 50 has four pairs of slots 56, each pair flanking a latch 58 used to retain the cover 50 to housing 30. The cover 50 is profiled to receive the cap member 20 closely therein, as shown in FIG. 2. The cover member is conveniently manufactured of injection molded plastic. A transparent or translucent plastic such as polycarbonate or acrylic is suitable for this purpose.

Shell member 60 has a shoulder 62 which fits against rearward end 34 of housing 30 and a converging portion 64 which extends to a cylindrical portion 65 having four circumferentially spaced tabs 66. The tabs 66 are pitched to engage the lamp base 70, which in this embodiment is an Edison base with a formed metal cylindrical portion 72 with inside threads which necessarily parallel the outside threads 73 and serve to engage the tabs 66, which thus serve as thread engaging means. A central contact 74 is electrically isolated from the metal portion 72 in usual fashion by glass or ceramic 76.

Referring to FIG. 2, the lamp tube 10 is fixed in cap member 20 by cement, so that the lamp and the cap member are assembled against ballast housing 30 as a unit. Ultrasonic bonding is then used to fix cap member 20 to housing. The cap member 20 and the barrier 33 thus define a secondary cavity 27 which thermally isolates the discharge tube from the ballast 48. The wire conduits 42 open on barrier wall 33 at respective apertures 46 which receive the respective wire leads. The inductive stabilization ballast 33 consists of a coil wrapped around an iron cone, the assembly being potted with a compound of epoxy to completely fill the primary cavity. This assures good thermal conduction to the circumferential wall 26 and thus good heat dissipation. The shell member 60 is also molded of glass filled plastic and is ultrasonically to the housing 30 after soldering the leads 1, 2, 3 to the ballast 48 and starter 6 as previously described. The leads 1, 4 are then soldered to base 70, which is then screwed onto shell 60 and dimpled or pinned thereto for positive retention.

The lamp unit according to the invention is thus compact, relatively inexpensive, and has good thermal performance. The described embodiment is not intended to limit the scope of the claims which follow.

I claim:

1. A lamp unit of the type comprising fluorescent tube means having wire leads extending therefrom, a lamp base to which at least some of said leads are connected, and a ballast housing between said tube means and said base, said ballast housing comprising a forward end toward said tube means, a rearward end toward said lamp base, and a circumferential wall extending therebetween, said wall substantially defining a primary cavity having therein an inductive stabilization ballast through which one of said leads is wired, characterized in that said housing further comprises a major partition bridging said circumferential wall, and a plurality of minor partitions extending between said major partition and said wall, at least some of said minor partitions defining individual wire conduits therebetween, said conduits extending between said forward end and said rearward end, at least some of said conduits having respective wire leads therein.

2. A lamp unit as in claim 1 wherein the ballast is surrounded by a compound which fills the primary cavity, whereby said circumferential wall facilitates heat loss from the ballast.

3. A lamp unit as in claim 1 wherein said housing further comprises a barrier which closes said cavity at the forward end of said housing.

4. A lamp unit as in claim 3 further comprising a cap member which fits against said forward end of said housing to define therewith a second cavity, said cap member having a base portion opposite said forward end of said housing, said base portion receiving said tube means therethrough so that said leads can communicate with said conduits.

5. A lamp unit as in claim 4 further comprising an elongate cover received over said tube means, said cover having an open end, a closed end, and a tubular portion therebetween, said cap being received in said open end.

6. A lamp unit as in claim 1 further comprising a shell member which fits against said rearward end of said housing, said shell member receiving said base thereagainst, said shell member converging between said housing and said base.

7. A lamp unit as in claim 6 wherein said base comprises a formed metal cylindrical portion with an internal thread, said shell member comprising a complementary cylindrical portion having thread engaging means thereon.

* * * * *